United States Patent [19]

Quinn, Jr.

[11] 4,372,699

[45] Feb. 8, 1983

[54] SHEET FEEDER FOR TYPEWRITERS

[75] Inventor: Paul A. Quinn, Jr., Lexington, Ky.

[73] Assignee: International Business Machines Corporation, Armonk, N.Y.

[21] Appl. No.: 283,694

[22] Filed: Jul. 15, 1981

Related U.S. Application Data

[63] Continuation of Ser. No. 85,826, Oct. 17, 1979, abandoned.

[51] Int. Cl.[3] ..... B41J 11/58; B41J 13/10; B65H 5/22

[52] U.S. Cl. ..... 400/625; 271/3; 400/629

[58] Field of Search ..... 271/3; 400/624, 625, 400/629

[56] References Cited

U.S. PATENT DOCUMENTS

| | | | |
|---|---|---|---|
| 2,280,964 | 4/1942 | Mixer | 271/23 |
| 3,008,709 | 11/1961 | Buslik | 271/10 |
| 3,645,615 | 2/1972 | Spear | 271/9 X |
| 4,089,402 | 5/1978 | Hyland et al. | 400/625 |
| 4,165,870 | 8/1979 | Fallon et al. | 271/10 |

FOREIGN PATENT DOCUMENTS 2413072 10/1975 Fed. Rep. of Germany ..... 271/3

OTHER PUBLICATIONS

*IBM Tech. Disc. Bulletin*, by H. R. Markham et al., vol. 21, No. 9, Feb. 1979, pp. 3538-3539, 3540-3542.

*Primary Examiner*—Paul T. Sewell
*Attorney, Agent, or Firm*—William J. Dick

[57] ABSTRACT

A sheet paper feed apparatus for a typewriter having a frame supporting a platen for holding and providing at least longitudinal motion to a sheet of paper. A rectangular tray includes forward and rear paper supports for supporting a stack of paper thereon. Therebetween is a shinglar roll or wheel which supports the central portion of the paper stack is a slightly bowed configuration. The shinglar wheel is first driven in a rearward fashion to effect removal of the forward or leading edge of the bottom most sheet from the stack away from the forward support, and then the shinglar wheel rotation is reversed effecting feeding of the sheet of paper away from the bottom of the stack and below the forward paper support into paper feed rolls and ultimately onto the platen.

3 Claims, 12 Drawing Figures

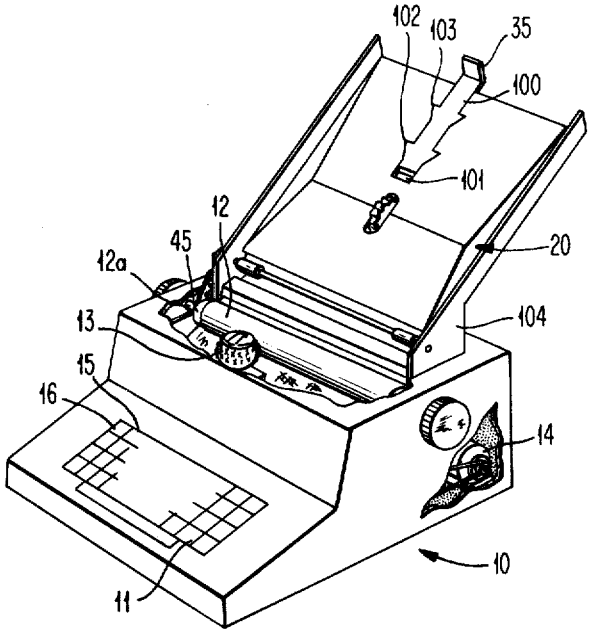
FIG. 2
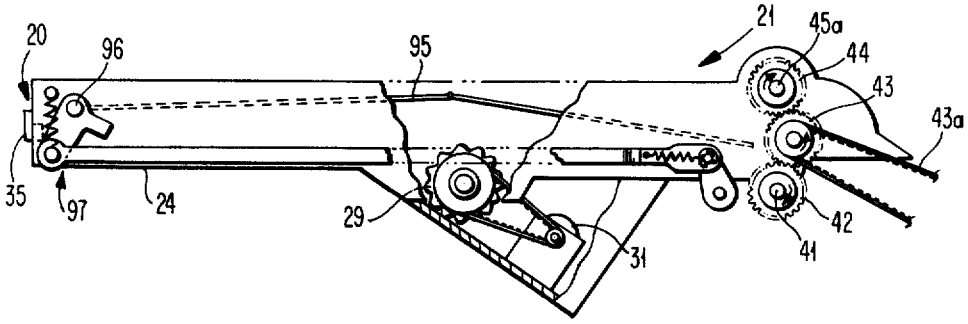

SHEET FEEDER FOR TYPEWRITERS

This is a continuation of application Ser. No. 85,826 filed Oct. 17, 1979 now abandoned.

SUMMARY OF THE INVENTION AND STATE OF THE PRIOR ART

The present invention relates to sheet paper feed apparatus for a typewriter, and more particularly relates to sheet paper feed apparatus including means for removing the bottom most sheet of paper and feeding the same to the platen of the typewriter.

Shingling apparatus for separating sheets and feeding the same have been in existance for sometime. For example, see U.S. Pat. No. 3,008,709 issued on Nov. 14, 1961 to Booslik. The uses of such shingling apparatus has been varied but conventionally has been employed in conjunction with some normal force to remove either the topmost or bottom most sheet from a stack of sheets of paper. Typical bottom sheet shingling apparatus is illustrated in the IBM Technical Disclosure Bulletin, Vol. 21, No. 9, February 1979, pages 3538, 3539; and 3540–3542; and U.S. Pat. No. 4,165,870, issued on Aug. 28, 1979 to John L. Fallon, et al.

In feeding individual sheets of paper to the platen of a typewriter, it is particularly advantageous if the sheet feeder can distinguish a single sheet of paper and present that single sheet of paper without additional drive or feed rolls for insuring separation to the platen of the typewriter inasmuch as this complicates the apparatus. Moreover, inasmuch as once the paper is in position in the platen for the typing operation, it is unnecessary to continue the feeding operation and, of course, it is advantageous to permit of an automatic means of discontinuing the shingling operation until it is again necessary to provide a fresh sheet of paper to the platen of the typewriter.

In view of the above, it is a principle object of the present invention to effect, in an easily attachable attachment, a single sheet feed apparatus from a stack of paper to the platen of a typewriter.

Another object of the present invention is to effect a single sheet feed apparatus which may be easily and economically constructed but which will operate reliably and with minimum operator attendance.

Yet another object of the present invention is to provide a sheet feeder apparatus for a typewriter which may also receive the finished typed product.

Other objects and a more complete understanding of the invention may be had with reference to the following specification and claims taken in conjunction with the accompanying drawings in which:

DRAWING DESCRIPTION

FIG. 1 is a fragmentary perspective view of a typewriter incorporating a sheet paper feeder constructed in accordance with the present invention;

FIG. 2 is a fragmentary side elevational view of the sheet feeder illustrated in FIG. 1;

Figure 6:
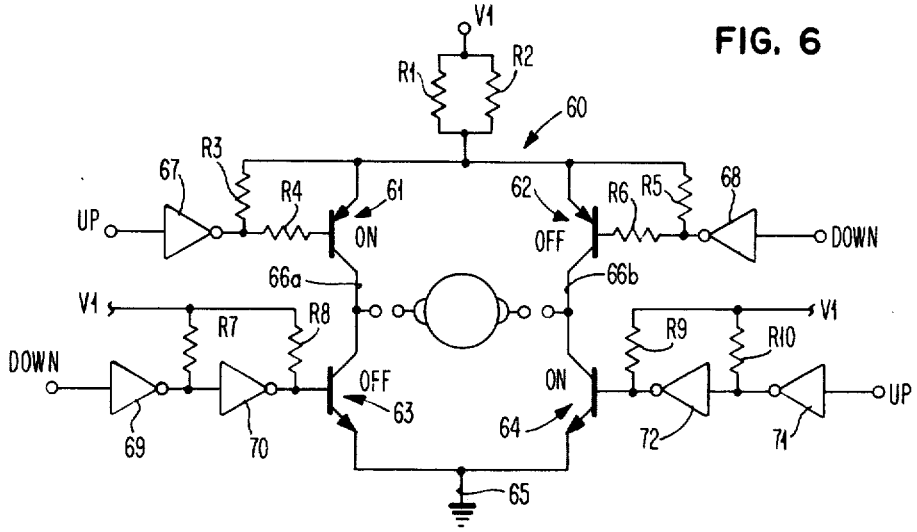
Figure 8:
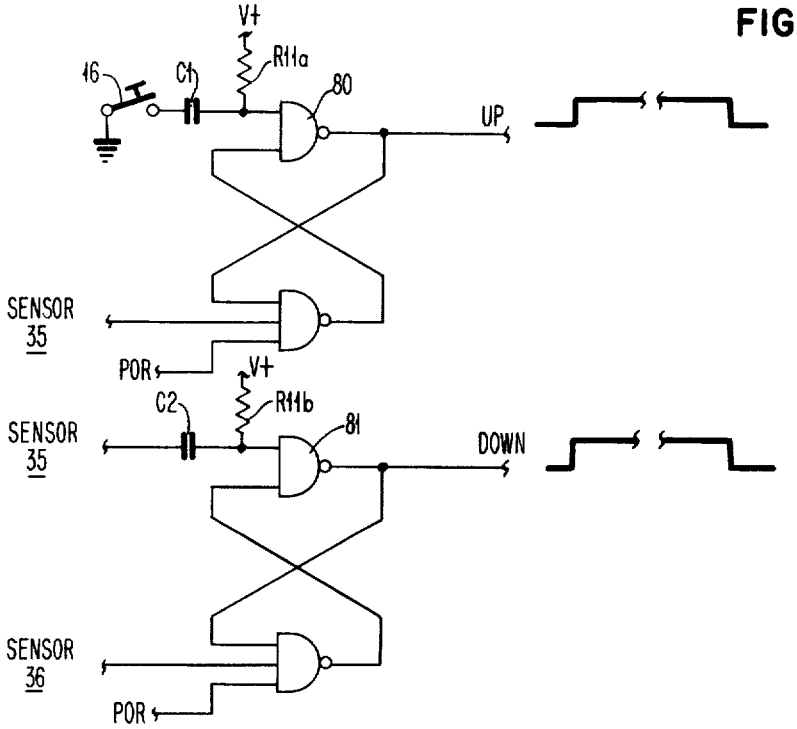
Figure 7A:
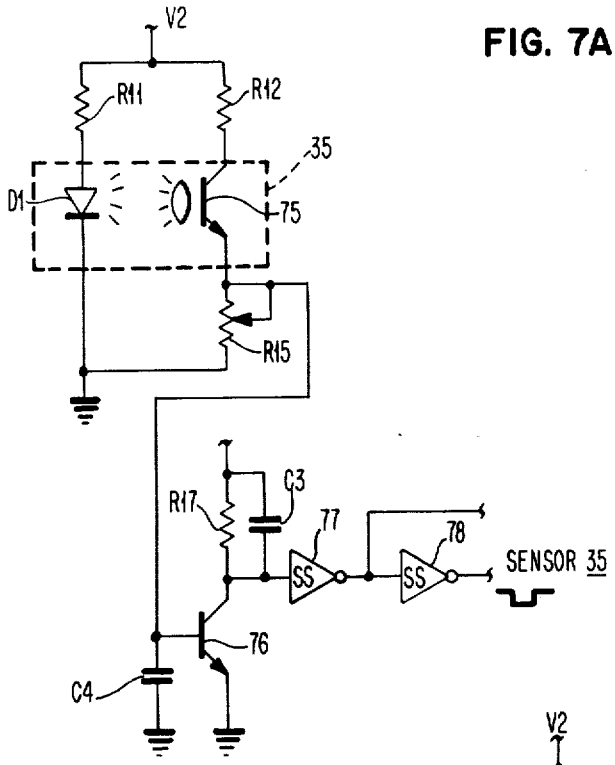
Figure 7B:
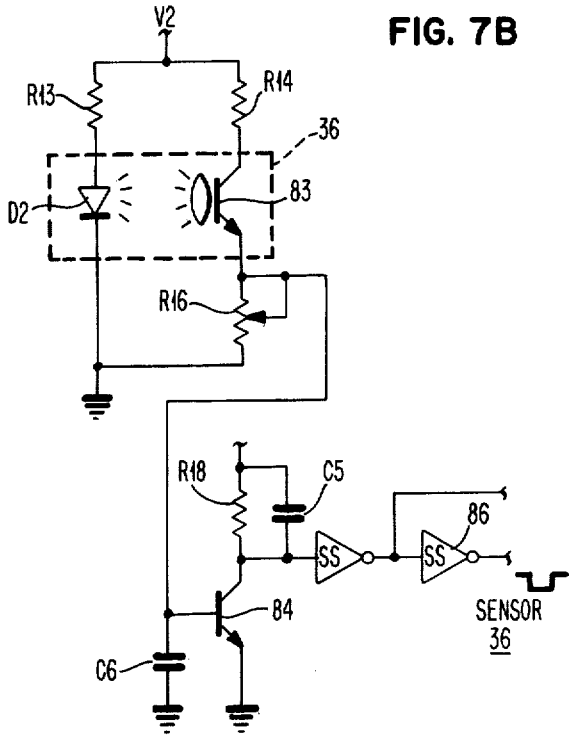

FIGS. 5A–D is a series of schematic views illustrating the feed of paper to and from the platen of a typewriter;

FIG. 6 is a schematic view of an electric drive circuit for a sheet feeder constructed in accordance with the present invention;

FIGS. 7*a* and 7*b* are schematic diagrams of the sensor circuitry which may be utilized in conjunction with the apparatus of the present invention; and FIG. 8 is a schematic diagram of typical circuitry which may be employed for controlling the operation of the apparatus illustrated and associated with the sheet feeder of the present invention.

Referring now to the drawings, and especially FIG. 1 thereof, a typical single element typewriter 10 having a sheet feeder 20 attached thereto and constructed in accordance with the present invention is illustrated therein. As shown, the typewriter 10 includes a keyboard and the like 11, a platen 12 and a typing element 13 which moves longitudinally of the platen 12 by means of a carrier (not shown) to imprint through, for example ribbon, indicia on paper wound in a conventional manner around the platen 12. In the present instance, the typewriter 10 includes a stepping motor and the like 14 which is coupled to the platen 12 to effect indexing of the platen (and thus a sheet or sheets of paper) either under operation of the operator as through a keybutton 15, automatically through pre-programming or through the conventional carrier return key located on the typewriter.

Figure 3:
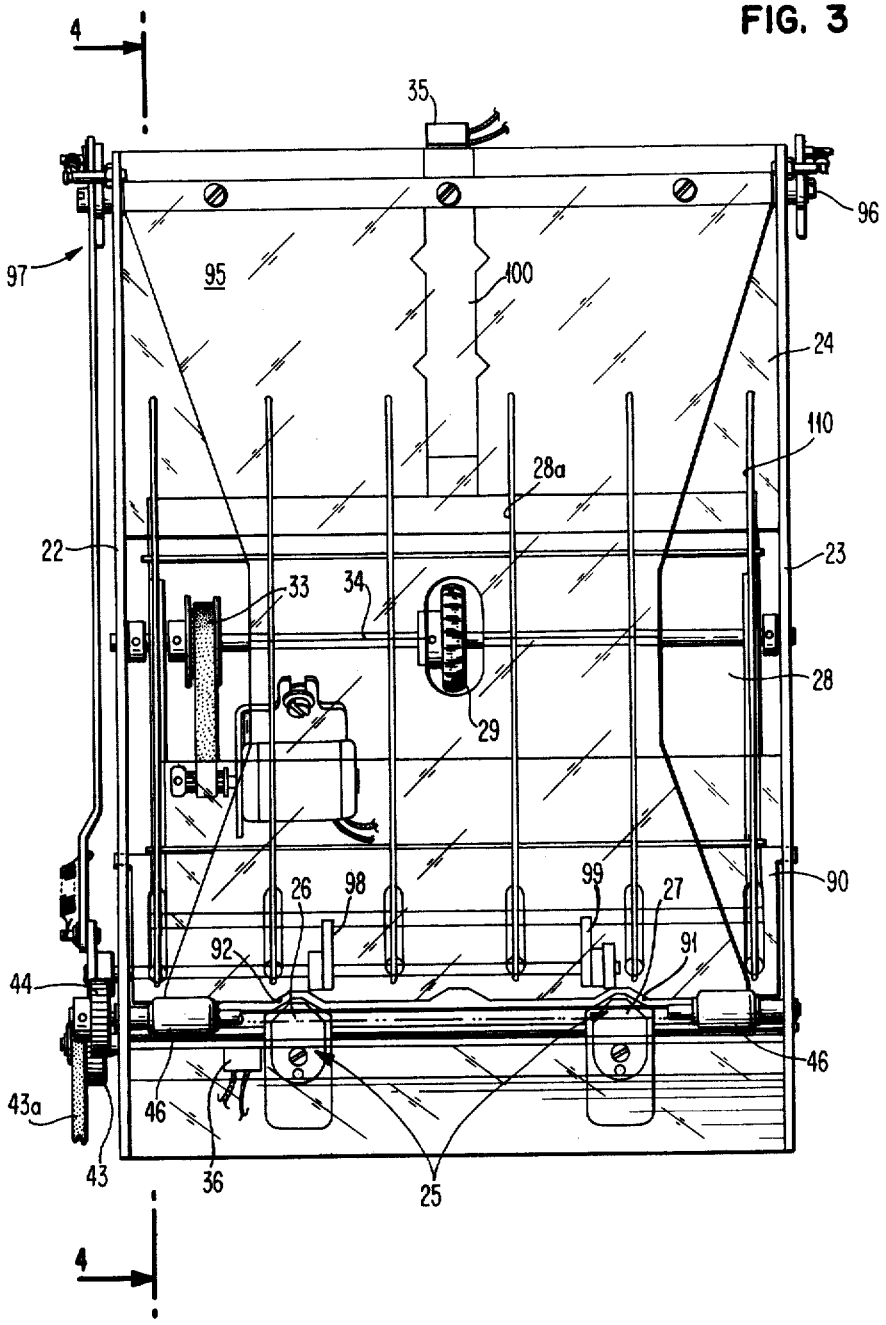
FIG. 3 is a plan view of the sheet feeder illustrated in FIGS. 1 and 2.
Figure 4:
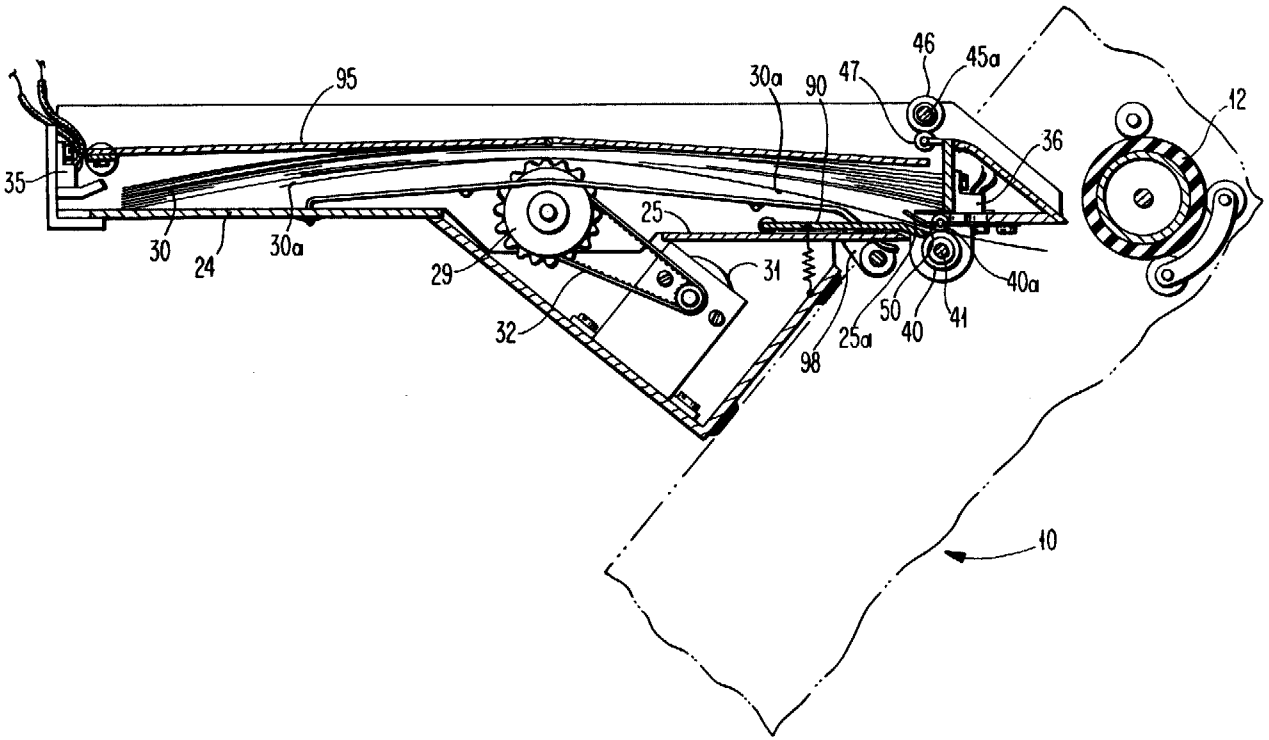
FIG. 4 is a fragmentary sectional view taken along lines 4—4 of FIG. 3.
Figure 5A:
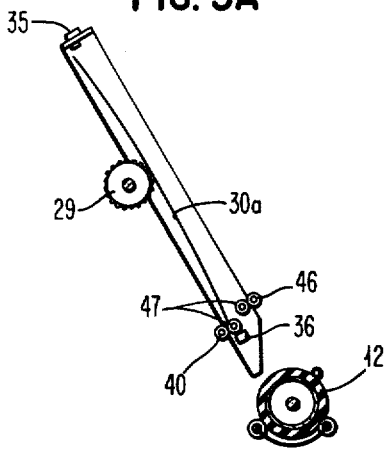
Figure 5B:
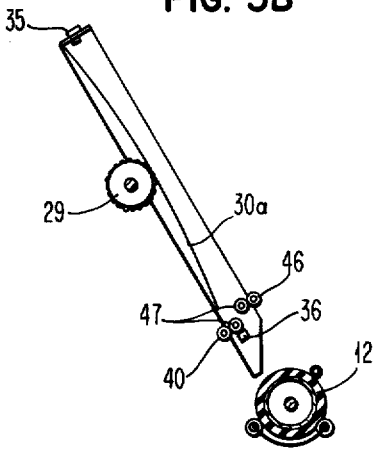
Figure 5C:
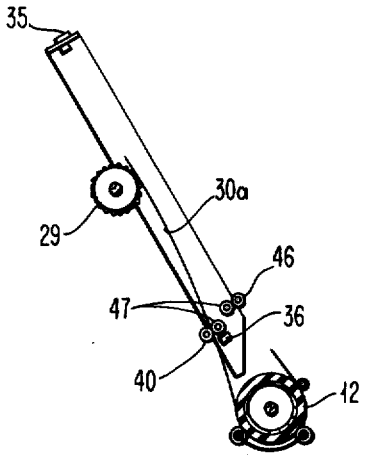
Figure 5D:
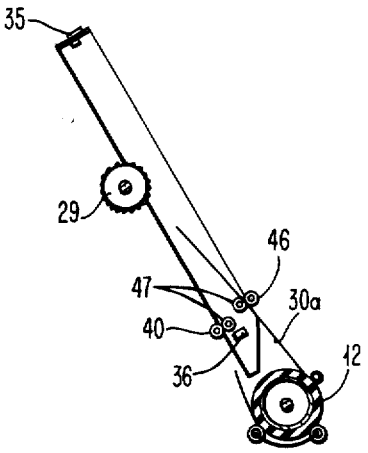

In accordance with the invention, the sheet feeder 20 is adapted to receive a stack or bundle of sheets of paper, remove the bottom sheet from the bundle and present the same to the platen 12 of the typewriter, and receive the finished sheet, if desired, from the platen. This is accomplished by first shingling the stack or bundle so that the bottom most sheet moves in a first direction away from the typewriter platen, and upon sensing of the single sheet the direction of movement of the shingler wheel is reversed to place the individual sheet between the nip of drive rolls which may conveniently be coupled to the platen. Thereafter the paper is fed to the platen so that as the platen rotates, the paper sheet is removed from the sheet feeder. To this end, and referring now to FIGS. 1–4, the sheet feeder comprises a generally rectangular tray 21 having upstanding sidewalls 22 and 23 which are spaced apart a sufficient distance to receive a bundle or stack of paper 30 upon which characters or other indicia may be imprinted by the typewriter 10. The tray includes a rear paper bundle or stack support portion 24, and a spaced apart forward paper support portion 25, the rear paper support portion 24 comprising a ledge or shelf while the forward paper support portion preferably comprises a pair of laterally spaced apart projecting fingers 26 and 27. As best illustrated in FIGS. 2–4, the forward and rear paper support portions 25 and 24 respectively are spaced apart so as to provide an opening 28 therebetween for receiving at least one shingler wheel 29 which projects upwardly into the space 28 above the plane formed by connecting the rear support portion 24 and the forward support portion 25 so that a stack of paper 30, supported by the rear support portion 24 and forward support portion 25, will rest intermediate its ends upon the shingler wheel 29 holding the paper stack or bundle 30 in a slightly bowed configuration (see FIG. 4). Thus the shingler wheel 29 engages the bottom most sheet 30*a* of the paper sheet stack 30.

In order to impart rotation to the shingler wheel 29 to remove the bottom most sheet 30*a* from the bundle or stack 30, drive means 31, for example a DC motor is coupled through a belt 32 to a pulley 33 mounted on a shaft 34 upon which is mounted the shingler wheel 29. In a manner which will be more fully described hereinafter, upon depression of a pack or paper feed button 16 on the typewriter keyboard 11, (FIG. 1) the DC motor drive means 31 will effect rotation of the shingler wheel 29 in the direction to effect shingling of the lower sheet 30*a* of the stack or bundle 30 in a first direction which is upwardly or away from the platen 12 of the typewriter. (Hereafter, up refers to the direction of sheet movement away from the platen and down refers to the direction of sheet movement towards the platen.) Shingling continues until the lower most sheet 30*a* is driven so that its lower edge 30*b* (FIG. 5B) drops off the forward support portion 25 or off the fingers 26 and 27 (FIG. 3). This condition is sensed by an upper or top sensor 35 which causes a reversal of the direction of motion of the DC motor 31 and thus a reversal in the direction of the motion of the shingler wheel 29.

After sensing of the bottom most sheet 30*a* of paper, by the sensor 35, and reversal of the motor drive 31 of the shingler wheel 29, the bottom most sheet 30*a* having dropped below the forward support portion 25 or fingers 26 and 27 is fed into and between a driven roller 40 and an idler roller 40*a* which is mounted beneath each of the fingers 26 and 27. In this connection, it should be noted that the portion 25 includes a downwardly deflecting camming surface 25*a* beneath the fingers 26 and 27 to aid in sheet separation and guidance of the sheet, the camming surface also mounting the idler roller 40*a* (FIG. 4). Adjacent the driven roller 40 is second sensor means or a lower sensor 36 (see FIG. 4) which serves to shut off the drive motor 31 stopping the shingling action.

In order to drive the roller 40 to effect feeding of the sheet of paper 30*a* through a slot like opening 50 to the platen 12 of the typewriter, in the preferred embodiment, the roller 40 which underlies both of the fingers 26 and 27 is connected to a shaft 41 which extends transversely of the tray 21 terminating in a gear 42 (FIG. 2) which is coupled through a driven gear 43 to a second driven gear 44, the purpose of the second driven gear 44 being more fully explained hereinafter. In the preferred embodiment, a belt 43*a* drive may be employed to connect the driven gear 43 to the typewriter platen, or any other convenient drive which would allow either manual rotation of the platen to effect removal of the paper, or motorized movement of the platen as by the motor 14 associated with the typewriter to move the paper through the platen to a start of print position. It should be recognized, however, that the coupling of the roller 40 to effect rotation thereof may be by any convenient mode or means to the platen 12, or to another drive source, it only being necessary that the lowermost sheet 30*a* of paper is fed through the chute like slot 50 into the platen. Alternately, the driven gear 42 may be coupled to the gear 45 on the platen shaft 12*a* so that rotation of the platen effects rotation of the drive gear 42 and thus the gears 43 and 44.

In order to remove paper from the platen, and in accordance with a feature of the present invention, the second driven gear 44 is coupled as by a shaft 45*a* (see FIG. 2) which also extends laterally of the tray 21, the shaft 45*a* being connected to a pair of spaced apart driven rollers 46 which serves to press the paper against idler rollers 47 to effect removal of the paper from the platen and place the finished sheet of paper on top of the stack 30.

It should be recognized that the operation of the tray pack may be controlled by simple timing devices which permit a time-out of the amount of time taken to move a bottom sheet during the operation of the shingler upwards or away from the platen and then a simple motor reversal with a sufficient time to permit movement of that bottom sheet beneath the ledge or fingers 26 and 27. Moreover, a simple electromechanical sensor such as a microswitch with a latching circuit may be employed to control the direction of rotation of the drive motor and its on and off period. However, the double sensor arrangement described more fully below is inexpensive and easily implemented and therefore is to be preferred.

The drive circuit for the DC motor or drive means 31 for the shingler wheel 29 is best illustrated in FIG. 6. As shown, the drive is a standard H configuration 60 including a pair of PNP transistors 61 and 62 connected to a voltage source V1 through resistors R1 and R2. The lower half of the H of the drive 60 is formed by two NPN transistors 63 and 64 having their emitters connected to ground as at 65 and their collectors connected to the collectors of the PNP transistors 61 and 62. The DC motor 31 is connected, as shown in FIG. 6, between the collector to collector leads 66*a* and 66*b* respectively connecting transistor 61 to transistor 63 and transistor 62 to transistor 64. The inputs to transistor 61 and 64 have been labeled "up" and for transistors 62 and 63 "down". (This refers to the direction of motor rotation which causes the bottom most sheet 30*a* of the stack 30 to move "up" towards sensor 35 and "down" towards the platen.) As illustrated, transistors 61 and 62 have a base input through biasing resistors R3 and R5 and resistors R4 and R6 connected as shown to the output of invertors 67 and 68 respectively. Moreover, the inputs to transistors 63 and 64 is through a pair of invertors to each base, notably invertors 69, 70 and 71, 72. Pull up resistors R7 and R8 as well as R9 and R10 serve their conventional purposes. By way of explanation, assume that an "up" signal (which refers with respect to FIG. 8 to the direction that the lower most sheet 30*a* be driven by the shingler wheel 29, in other words with respect to FIG. 4, the rotation of the shingler wheel is in the counterclockwise direction), and that the "up" signal is a positive going wave form, the invertor 67 inverts the wave form and turns on transistor 61 causing current to flow from the power supply through transistor 61. Additionally, the "up" signal is also applied to transistor 64 through the double inventor 71 and 72 turning on transistor 64. In this manner, current flows through transistor 61, the motor 31 to the transistor 64 and ultimately to ground 65. At the same time, the signal on transistors 62 and 63 is low, these transistors are turned off and no current flows through transistors 62 and 63. In the manner just described, the DC motor 31 will effect rotation of the shingler wheel forcing the lower most sheet 30*a* upwardly until the sensor 35 "sees" the paper, and a reversal of the motor direction and thus of the shingler wheel occurs. In this condition, a positive wave form signal is applied to the down inputs of transistors 62 and 63 respectively, and the up signal going to transistors 61 and 64 is turned off. The high signal applied to the input of invertor 68 associated with transistor 62 causes the PNP transistor 62 to turn on permitting current to flow through transistor 62, the motor 31 and the turned on transistor 63. Transistor 63 is turned on because of the positive going wave form applied to invertor 69 and 70 effects a raising of the base voltage of the NPN transistor 63 allowing current to flow to ground 65 through that path and thus through the DC motor causing a reversal of direction of the motor.

The control circuit for effecting turn on of the DC motor 31 and operation of the H drive 60 to cause motor turn on and turn off as by the sensors 35 and 36 respectively is described best in FIG. 7 and FIG. 8. Referring first to FIG. 8, the sheet feed button 16, when depressed, causes current to flow from the pull up resistor R11 through the uncharged capacitor C1 to ground causing a negative going spike to be formed at the input to a latch 80 causing an up going or positive wave form to occur at the output labeled "up" which is applied to transistors 61 and 64 as heretofore described (FIG. 6). The "POR" signal input to latch 80 occurs during machine turn on so that a power-on-reset signal causes the output "up" to be initially low, i.e. "POR" sets the initial state of latch 80.

Referring now to FIG. 7*a*, the top or upper sensor 35 includes a standard source of voltage V2 which applies the voltage through resistor R11 and R12 to light emitting diode D1 and phototransistor 75. The phototransistor 75 is positioned on the same side of the sheet 30*a* as light emitting diode D1 so that it operates in a reflectance mode. The output of the phototransistor 75 is applied to an amplifier 76 turning on NPN transistor 76 and applying a pulse to a schmitt trigger invertor 77 and through a second schmitt trigger invertor 78 to provide a "sensor 35" output with a pulse shape similar to that shown in FIG. 7*a* at the output of schmitt trigger invertor 78. Upon the occurrence of the phototransistor 75 seeing a sheet of paper such as the lower most sheet 30*a*, sensor 1 provides an output such as illustrated in FIG. 7*a* to the latch 80 causing latch 80 to change state thus turning off transistors 61 and 64 and thus turning off motor 31.

Simultaneously the output sensor 35 is applied to a second latch 81 which causes the output of that latch to go up, the wave shape or form being substantially as illustrated in FIG. 8 now turning on transistors 62 and 63 as heretofore described and causing the DC motor 31 to operate in the reverse direction. It should be noted that the capacitor C2 gives a slight delay in the change of state of latch 81 which insures that transistors 61 and 64 are turned off prior to transistors 62 and 63 being turned on to reverse motor direction.

The bottom sensor 36 is identical to the top sensor 35 and includes resistors R13, R14 connected to the source of voltage V2, the sensor including a light emitting diode D2 and phototransistor 83 which operates, in the reflectance mode so that the NPN transistor amplifier 84 is turned on when the phototransistor sees the presence of paper. Once again, the output of the amplifier is through a pair of schmitt trigger invertors 85 and 86 which outputs a signal labeled "sensor 36", with a waveform substantially as illustrated in FIG. 7*b* to the other device of the latch 81 (FIG. 8), causing latch 81 to change state to low, turning off transistors 62 and 63 respectively.

For ease of construction of the circuits shown in FIGS. 6–8, a table of parts is set forth below:

Table of Parts:

(All resistors ½ W. unless otherwise stated)
R1, R2—5ω 1 W
R3, R5—20K
R4, R6—5K
R7, R10, R11*a,b*, R17, R18, R19, R20—10K
R8, R9, R12, R14—1K
R15, R16—10K Potentiometer
C1, C2—0.01 μfd
C3, C5—0.68 μfd
C4, C6—0.001 μfd Transistors 61–64 Darlington Pairs Although it is a simple matter for the typist to place the stack of paper 30 on the forward and rear paper support portions 25 and 24 respectively, to prevent inadvertant errors by the typist in failing to place the paper bundle on the forward support or fingers 26 and 27, a temporary support 90 having cutouts 91 and 92 in the area of the fingers 26 and 27 is hingably connected to the upstanding sidewalls 22 and 23 to support the bottom edge of the paper stack when it is initially placed into the tray on the rear paper support portion.

As shown best in FIGS. 2 and 3, the support 90 is operated by a cover 95 which must be lifted by the operator about pivot 96 when the operator loads paper into the tray onto the rear support portion 24 and the support 90. As the cover member 95 is elevated about the pivot 96, linkage 97 coupled to the cover 95 effects clockwise rotation (relative to FIG. 4) of a pair of cams 98 and 99 which bear against the lower surface of the support 90, causing the support 90 to rotate upwardly above the fingers 26 and 27 which form the forward support portion 25. In this manner, when the operator inserts paper onto the tray, the cover is first elevated causing upward rotation of the support 90 permitting paper to be placed thereon with no chance of paper inadvertently separating and falling beneath the fingers 26 and 27. As shown, as the cover is rotated clockwise and placed on top of the stack or bundle of paper, the cams 98 and 99 depress allowing the cover member 90 to recess below the plane of the fingers 26 and 27 and permitting the stack of paper to be supported on the fingers. The cover 95 also serves additional functions of acting as a separator for finished sheets permitting easy separation by the operator, and as a weight for increasing the pressure of the stack of paper against the shingler wheel 29.

In order to accommodate different paper lengths, it is preferrable that the sensor 35, as illustrated in FIG. 1, be mounted on a slide 100 on the rear support portion 24 of the tray, the slide 35 being fittable into a groove 101 and detented as at 102, 103 so that the operator may choose the position of the first sensor 35 dependent upon paper length. Of course, it should be recognized that with suitable modifications the tray could be permitted to move laterally to accommodate papers of varying widths.

As best illustrated in FIG. 1, the sheet feeder is preferrably set at an angle with respect to the typewriter 10 which facilitates the feed of paper to the platen 12. Thus the chute 50 will be preset at a particular angle for a particular typewriter, and may be easily fastened or connected to the rear cover or frame of the typewriter as by the angled stand 104 in a conventional manner, such as self-tapping screws, wing nuts and bolts, etc., or may be made a permanent part of the typewriter as desired.

Moreover, if desired and as best shown in FIG. 3, a metallic wire support grid 110 having a suitable opening 28*a* therein to permit the projection therethrough of the shingler wheel, is provided with a convex bow. The grid is preferably supported in the tray to insure bowing of the paper stack 30 in the desired direction, and by connecting the grid 110 to ground also serves to bleed off electrostatic charges on the lower most sheet 30*a* of the paper stack 30.

Thus the sheet feeder of the present invention provides a simple and economical pack feed capability for a typewriter, especially being adapted to an automatic typewriter which will permit of self-feeding of sheets of paper in a position for a typist.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed.

What is claimed is:

1. A sheet paper feed apparatus for a typewriter for feeding individual sheets of paper to the platen of the typewriter, said typewriter including platen drive means for feeding paper around the platen and into a position for typing thereon; said apparatus comprising:

a rectangular tray including a rear paper support portion and a spaced apart forward paper support portion for supporting thereon the opposite ends of a stack of paper;

a shingler wheel intermediate said support portions, and projecting above a plane lying through said support portions to engage the lowermost sheet of said stack of paper and to support the center of the stack of paper to form a concave bow therein so that only the opposite ends of said stack of paper are supported by said support portions; a motor drive means connected to said shingler wheel to effect reversable rotation thereto, said motor responsive to a first command for effecting rotation of said shingler wheel in a first direction to slide the lowermost sheet of paper of said stack of paper towards said rear support portion until said forward support portion no longer supports said lowermost sheet;

first sensing means mounted on the tray for sensing separation of said sheet of paper from said forward support portion;

paper sheet camming means beneath said forward support portion to aid in downward deflection of said lowermost sheet, and circuit means responsive to the sensing means sensing such separation for effecting motor drive means direction reversal and thus reversal of the direction of rotation of said shingler wheel to thereby urge said lowermost sheet in a second direction under said forward support portion toward said platen;

a first sheet drive roll adjacent said camming means for grasping said lowermost sheet and means for effecting rotation of said first sheet drive roll for directing said lowermost sheet of paper towards the platen of said typewriter, and a second sheet drive roll superimposed of said first sheet drive roll, and means for effecting rotation of said second sheet drive roll in synchronism with rotation of said first sheet drive roll and said platen to advance sheets of paper received from the platen of the typewriter to a position superimposed of said stack of paper.

2. A sheet paper feed apparatus in accordance with claim 1 including second sensor means adjacent said first sheet drive roll to indicate the presence of said lowermost sheet at said first sheet drive roll, and second circuit means responsive to an output from said second sensor to stop rotation of said motor drive means.

3. A sheet paper feed apparatus in accordance with claim 1 or 2 wherein said forward support portion comprises a pair of laterally spaced apart fingers projecting inwardly of said tray, said paper sheet camming means underlying said fingers and including an upwardly directed and sloped surface to effect said downward deflection of the leading edge of said lowermost sheet of said stack upon reversal of the shingler wheel and thus movement of the lowermost sheet of paper fed in the second direction towards said first sheet drive roll.

* * * * *